US005304317A

United States Patent [19]

Barwise et al.

[11] Patent Number: 5,304,317

[45] Date of Patent: Apr. 19, 1994

[54] FROTH FLOTATION OF FINE PARTICLES

[75] Inventors: Christopher H. Barwise, Fording Bridge; John Wilson, Swanwick, both of England

[73] Assignee: Fospur Limited, Derby, United Kingdom

[21] Appl. No.: 979,918

[22] Filed: Nov. 23, 1992

Related U.S. Application Data

[62] Division of Ser. No. 857,408, Mar. 25, 1992, Pat. No. 5,217,604.

[30] Foreign Application Priority Data

Mar. 28, 1991 [GB] United Kingdom ..... 9106747

[51] Int. Cl.[5] ..... B03D 1/016; B03D 1/02

[52] U.S. Cl. ..... 252/61; 209/5; 209/166; 526/263

[58] Field of Search ..... 209/166, 167, 5; 252/61; 526/263

[56] References Cited

U.S. PATENT DOCUMENTS

| | | | |
|---|---|---|---|
| 3,142,664 | 7/1964 | Bauer | 526/263 |
| 3,171,784 | 3/1965 | Witwer | 526/263 |
| 3,256,141 | 6/1966 | Stephenson | 209/166 |
| 3,406,238 | 10/1968 | Freyermuth | 526/263 |
| 3,417,054 | 12/1968 | Merijan | 526/263 |
| 3,782,546 | 1/1974 | Kirwin | 209/166 |
| 3,929,629 | 12/1975 | Griffith | 209/167 |
| 4,141,691 | 2/1979 | Antonetti | 209/166 |
| 4,268,379 | 5/1981 | Poulos | 209/166 |
| 4,584,095 | 4/1986 | Unger . | |
| 4,756,823 | 7/1988 | O'Neill | 209/166 |
| 4,857,221 | 8/1989 | Brookes | 209/166 |
| 4,859,310 | 8/1989 | Brookes | 209/166 |

FOREIGN PATENT DOCUMENTS

| | | | |
|---|---|---|---|
| 47200 | 4/1974 | Australia | 209/166 |
| 2175174 | 10/1973 | France | 209/167 |
| 162362 | 12/1980 | Japan | 209/166 |
| 407584 | 4/1974 | U.S.S.R. | 209/167 |
| 421371 | 11/1974 | U.S.S.R. | 209/167 |
| 712130 | 1/1980 | U.S.S.R. | 209/166 |
| 822903 | 4/1981 | U.S.S.R. | 209/166 |
| 923624 | 4/1982 | U.S.S.R. | 209/166 |
| 1002015 | 3/1983 | U.S.S.R. | 209/166 |
| 1318304 | 6/1987 | U.S.S.R. | 209/166 |

*Primary Examiner*—Thomas M. Lithgow
*Attorney, Agent, or Firm*—Nixon & Vanderhye

[57] ABSTRACT

Additive composition for use in separating particles of a desired material from particles of an undesired material in a froth flotation process using a frother. The composition includes an alkylated polymer of vinylpyrrolidone and a liquid carrier comprising the frother.

3 Claims, No Drawings

FROTH FLOTATION OF FINE PARTICLES

This is a division of application Ser. No. 07/857,408, now U.S. Pat. No. 5,217,604 filed 25 Mar. 1992.

This invention relates to the froth flotation of fine particles and in particular to the recovery of coal from an aqueous slurry of coal fines also containing associated impurities as suspended fine solids by froth flotation, and to the beneficiation of fine mineral particles by froth flotation.

Coal as mined (run-of-mine-coal) contains a proportion of shale which when treated in water in a coal washery tends to revert to the original clay from which it was compressed in geological times. Separation of the coal from the fine shale and clay particles presents considerable problems. In the case of mines where modern, mechanical extraction techniques are used, typically a proportion as high as about 20% of the run-of-mine-coal consists of particles smaller than 0.5 mm. This fine "coal" typically has a substantial coal content but also a substantial shale content so it is important to make use of the coal content but also to remove shale from it. Modern coal preparation processes result in the fines (separated from coarser material) being in the form of aqueous slurries.

In the United Kingdom the usual way of separating coal fines from shale fines in aqueous slurries is by means of froth flotation followed by filtration.

In the froth flotation process the partially hydrophilic coal particles are treated with a surface active chemical compound, know as a "collector", so as to render the surface of the particles hydrophobic, so that it is attracted to air rather than water, adding a so-called "frother", either mixed with the collector to form a so-called "froth flotation oil", or independently, to enable a froth of the required stability to be produced, and then aerating the aqueous suspension so that the coal is recovered in the froth so formed. The efficiency of this process is seriously affected by the presence of ultra-fine (of less than about 50 microns) matter (both coal and shale), often present in significant proportions in the material requiring treatment.

The beneficiation of fine mineral particles by froth flotation is carried out in a similar manner, the particles of the mineral which it is desired to recover being rendered hydrophobic by the addition of a "collector" to an aqueous slurry of the mineral particles and particles of other minerals which it is not desired to recover, followed by the addition of a frother, and flotation of the particles of the desired mineral.

The largest particle present within a mass of mineral particles which are to be separated by froth flotation must be of a size such that the desired mineral particles will be physically released from the unwanted mineral particles and that the mass of each of the desired mineral particles does not exceed its force of attraction to an air bubble under the conditions of turbulence occurring in the aqueous suspension of mineral particles. It is therefore generally necessary to grind minerals so that the particles are sufficiently small for separation by an industrial froth flotation process. During the grinding process it is inevitable that some of the particles produced will be finer than intended and particles of the desired mineral which are too fine are generally difficult to recover by froth flotation. The size at which the difficulty is met will depend on a number of factors, including the specific gravity of the mineral which it is desired to recover, the degree of turbulence within the aqueous suspension of mineral particles and the size range of the air bubbles in the suspension. Commonly, recovery of the desired mineral and rejection of unwanted minerals starts to deteriorate when the mineral particles are finer than about 10 microns, becoming very poor when the particles are finer than about 1 micron. These difficulties are commonly referred to as sliming problems.

GB patent publication 2190310A describes a process in which coal fines are separated from shale fines by means of a froth flotation process and in which the particles of coal are treated with a hydrophobic polymer, such as a polyvinylalkyl ether, which is highly selective as a flocculant for the coal fines in preference to the shale fines. GB patent publication 2212418A describes a similar process in which particles of a desired mineral are recovered from particles of an unwanted mineral in an aqueous slurry by means of froth flotation, after treatment with a predominantly hydrophobic polymeric flocculating agent which selectively flocculates the desired mineral particles.

It has now been found that alkylated polymers of vinylpyrrolidone are particularly useful as selective flocculants in the froth flotation processes of the types described in GB patent publications 2190310A and GB 2212418A.

According to the invention in one aspect there is provided a process for separating particles of a desired material from particles of an undesired material, in which a collector for the desired material and a frother and an alkylated polymer of vinylpyrrolidone are added to an aqueous slurry containing the particles of the desired material and the particles of the undesired material, and the particles of the desired material are floated in a froth flotation cell.

The process of the invention may be used to recover coal fines from an aqueous slurry containing coal fines and shale fines, and also to recover fine particles of a desired mineral from an aqueous slurry containing both the particles of the desired mineral and fine particles of one or more undesired minerals. The process is useful when treating a slurry arising in the treatment of copper ores, copper nickel ores, and ores containing copper and metals of the platinum group.

The alkylated polymers of vinylpyrrolidone are available commercially under the trade mark ANTARON from GAF Corporation. The polymers have exceptional surface activity and exhibit different hydrophobic/hydrophilic balances, depending on the molecular weight of the alkyl group and its ratio to vinylpyrrolidone.

The term alkylated polymers of vinyl pyrrolidone, more correctly 2-pyrrolinone, 1-ethenyl homopolymers, defines polymers preferably of the general formula

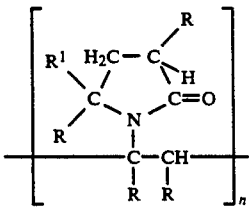

where R is hydrogen or an alkyl group, and the total number of carbon atoms in the alkyl group or groups is from about 4 to 30, preferably 8 to 20, most preferably 16. The polymer is selected according to the intended degree of hydrophobicity and the ease with which the polymer may be presented, e.g. dissolved or dispersed in a liquid. The polymers may be prepared by copolymerisation of vinylpyrrolidone and a long chain olefin to form the desired copolymer. Copolymers may be used. A mixture of polymers may be used.

To be useful in the process of the invention the alkylated polymers of vinylpyrrolidone must be dispersible in water. If the polymer is a liquid it can either be dispersed directly in the aqueous slurry or predispersed or dissolved in a carrier liquid. If the polymer is a solid it must be predispersed or dissolved in a carrier liquid. If desired a dispersant or emulsifying agent, such as a nonionic alkoxylated ester of fatty acids may be used to aid dispersion of the polymer.

In another aspect the invention provides an additive composition for use in separating particles of a desired material from particles of an undesired material, the additive composition comprising an alkylated polymer of vinylpyrrolidone and a carrier liquid therefor.

When the process is used to recover coal fines the carrier liquid for the polymer may be a conventional collector as used in the froth flotation of coal, for example gas oil, Diesel oil, kerosene or other petroleum or coal-based distillates, or mixtures thereof. The polymer may also be dispersed or dissolved in a conventional froth flotation oil which consists of not only the collector but also the frother, and possibly other additives such as an emulsifier or dispersant.

When the process is used to recover a desired mineral from an undesired mineral the frother which is used in the conventional froth flotation may act as the carrier liquid for the polymer. Any of the known frothing agents used in the froth flotation of minerals, for example methylisobutylcarbinol, a propoxylatedbutanol or a polypropylene glycol, may be used as the carrier.

In the recovery of coal fines the amount of polymer used will usually be in the range of about 0.3 g to about 200 g per tonne of solids treated, and when the polymer is added as part of an additive composition containing the collector and the frother the additive composition will usually contain about 0.2% to about 20% by weight of polymer, about 50% to about 90% by weight of collector or carrier liquid and about 10% to about 30% by weight of frother.

In the recovery of a desired mineral the amount of polymer used will usually be in the range of about 0.1 g to about 10 g per tonne of total mineral solids or about 0.5 g to about 50 g per tonne of the desired mineral, and when the frother acts as the carrier liquid for the polymer the additive composition will usually contain about 0.2% to about 25% by weight of polymer and about 75% to about 99.8% by weight of frother.

Although in the recovery of a desired mineral the polymer is usually added to the frother as the polymer is soluble in the frother, if the polymer is soluble in the collector or another flotation reagent, such as a modifier (which modifies the collection or flotation), the polymer may be added to that reagent.

The polymer acts as a selective flocculant for the fine particles of the desired material thus increasing yield, and it also has other beneficial effects. In the recovery of coal fines the polymer yields a very dry froth compared to that obtained in a conventional froth flotation process, and it also aids recovery of coal at the coarser end of flotation (typically 250 to 500 microns size range).

It has also been found that an alkylated polymer of vinylpyrrolidone is particularly useful when it is used in conjunction with a hydrophobic polyvinylalkyl ether, such as polyvinylmethyl ether, polyvinylethyl ether or polyvinylisobutyl ether as a selective flocculant, and that when used together the alkylated polymer of vinylpyrrolidone and the polyvinylalkyl ether are complementary in their effect.

The following example will serve to illustrate the invention in which all parts are percent by weight unless otherwise stated.

In the examples, the alkylated polymer of vinylpyrrolidone was according to the general formula as set out above wherein the value of R is a total of 16 carbon atoms. The froth flotation oil was a hydrocarbon oil acting as a collector, and containing an emulsifier and a frother. The polyvinylethyl ether was available under the trade mark LUTANOL A25 from BASF United Kingdom Ltd.

EXAMPLE

Three additive compositions were prepared as follows:

| | | |
|---|---|---|
| (1) | proprietary froth flotation oil | 95 |
| | alkylated polymer of vinylpyrrolidone (ANTARON V-216) | 5 |
| (2) | proprietary froth flotation oil | 85 |
| | alkylated polymer of vinylpyrrolidone (ANTARON V-216) | 15 |
| (3) | proprietary froth flotation oil | 94 |
| | alkylated polymer of vinylpyrrolidone (ANTARON V-216) | 1 |
| | polyvinylethyl ether (LUTANOL A25) | 5 |

Froth flotation tests were carried out on a coal/shale slurry in which the particle size of the solids was less than 700 microns and 95% less than 500 microns and the solids content was 5.1, using each of the compositions (1) to (3) and as a control the proprietary froth flotation oil alone. In each test 0.062 g of the composition was added to 2.65 liters of the slurry in a Denver DR cell turning at 1500 rpm. After a conditioning time of 1 minute the air supply to the cell was turned on, and the froth which was produced was taken off for 160 seconds. The results obtained are tabulated below:

TABLE

| ADDITIVE COMPOSITION | Control | 1 | 2 | 3 |
|---|---|---|---|---|
| COAL PRODUCT | 39.4 | 42.4 | 43.2 | 45.9 |
| COAL PRODUCT % ASH | 11.3 | 9.6 | 10.5 | 10.1 |
| TAILING % ASH | 75.5 | 79.1 | 80.2 | 79.4 |
| COMBUSTIBLES RECOVERY % | 70.2 | 76.1 | 77.5 | 78.7 |
| FEED % ASH CALCULATED | 50.2 | 49.6 | 50.1 | 47.6 |

These results indicate that the alkylated polymer of vinylpyrrolidone polymer either on its own or in conjunction with the polyvinylethyl ether selectively flocculates the ultra-fine coal particles improving the selectivity of their recovery from the ultra-fine shale and clay.

We claim:

1. An additive composition for use in separating particles of a desired material from particles of an undesired material in a froth flotation process, said additive composition comprising about 0.2% to about 20% by weight of an alkylated polymer of vinylpyrrolidone and a carrier liquid therefor, said carrier liquid comprising about 50% to about 90% by weight of a collector and about 10% to about 30% by weight of a frother.

2. An additive composition according to claim 1, wherein said alkylated polymer is present in an amount of about 0.2% to about 2% by weight.

3. An additive composition according to claim 1, including a hydrophobic polyvinyl alkyl ether.

* * * * *